US011359362B2

(12) United States Patent
Boeltl

(10) Patent No.: US 11,359,362 B2
(45) Date of Patent: Jun. 14, 2022

(54) LIGATURE RESISTANT FLOOR DRAIN AND GRATE

(71) Applicant: Acorn Engineering Company, City Of Industry, CA (US)

(72) Inventor: Darryl M. Boeltl, Whittier, CA (US)

(73) Assignee: Acorn Engineering Company

( * ) Notice: Subject to any disclaimer, the term of this patent is extended or adjusted under 35 U.S.C. 154(b) by 0 days.

(21) Appl. No.: 16/818,548

(22) Filed: Mar. 13, 2020

(65) Prior Publication Data

US 2020/0291631 A1 Sep. 17, 2020

Related U.S. Application Data

(60) Provisional application No. 62/819,300, filed on Mar. 15, 2019.

(51) Int. Cl.

| | |
|---|---|
| ***E03F 5/06*** | (2006.01) |
| ***E03F 5/04*** | (2006.01) |
| ***E03C 1/26*** | (2006.01) |

(52) U.S. Cl.

CPC ..... *E03F 5/06* (2013.01); *E03C 1/26* (2013.01); *E03F 5/0407* (2013.01)

(58) Field of Classification Search

CPC .. E03F 5/0407; E03F 5/06; E03C 1/22; E03C 1/26

USPC ..... 210/163, 164; 4/679, 286, 292; 52/302.1

See application file for complete search history.

(56) References Cited

U.S. PATENT DOCUMENTS

| | | | | |
|---|---|---|---|---|
| 2,119,923 | A * | 6/1938 | McIntyre | E03F 5/08 210/164 |
| 4,257,892 | A * | 3/1981 | Boersma | E03F 5/0407 210/163 |
| 4,321,713 | A * | 3/1982 | Thompson | E03F 5/0407 4/286 |
| 8,496,811 | B2 * | 7/2013 | Cohen | E03C 1/264 210/163 |
| 10,184,239 | B2 * | 1/2019 | Meincke | E03F 5/06 |
| 2006/0219619 | A1 * | 10/2006 | St-Cyr | E03F 5/06 210/164 |

(Continued)

FOREIGN PATENT DOCUMENTS

| | | |
|---|---|---|
| CN | 201704783 U | 1/2011 |
| CN | 207525863 U | 6/2018 |

OTHER PUBLICATIONS

303070X—Safe-Cell (R) Anti-Ligature Floor Drain Assembly data sheet (2015).

(Continued)

*Primary Examiner* — Christopher Upton
(74) *Attorney, Agent, or Firm* — Eric J. Sosenko; Jonathan P. O'Brien; Honigman LLP

(57) ABSTRACT

A strainer for a ligature resistant floor drain and a ligature resistant floor drain incorporating a strainer. The strainer includes a top plate with two sets of openings forming rings. A cylindrical extension extends from the top plate at a location between the rings. Also provided are two series of webs, each web of which is located between an adjacent pair of openings in one of the rings. Optionally, a strainer plate is attached to the cylindrical extension and extends at least one of radially inward and outward relative from the cylindrical extension. The floor drain further includes a strainer frame having a receptacle into which the strainer is received.

27 Claims, 4 Drawing Sheets

(56) References Cited

U.S. PATENT DOCUMENTS

| | | | | |
|---|---|---|---|---|
| 2010/0320130 | A1* | 12/2010 | Meyers | E03F 5/0409 210/164 |
| 2019/0099045 | A1 | 4/2019 | Acers | |

OTHER PUBLICATIONS

303070x Photographs (photographs of current product offered under the 303070x model number (product received May 21, 2021 and photographs taken Jun. 11, 2021).
Whitehall Manufacturing data sheet, WHFD series Ligature Resistant Floor Drain (Jul. 29, 2016).
Whitehall Manufacturing data sheet, WHDG series Ligature Resistant Floor Drain (Aug. 4, 2018).
Exhibit A—Sent by Daniel J. Lueders to Applicant's counsel (Mar. 4, 2021).

* cited by examiner

LIGATURE RESISTANT FLOOR DRAIN AND GRATE

BACKGROUND

1. Field of the Invention

The present invention generally relates to floor drains, such as a floor drain intended to be installed in a concrete floor. More specifically, the invention relates to a floor drain, and a grate for a floor drain, that is resistant to the attachment of a ligature device.

2. Description of Related Art

Floor drains are installed in buildings so that liquid, usually water, received on the floor is quickly and easily drained off of the floor, preventing both people from slipping on the floor and damage to the floor or other structural aspects of the installation site. Since the floor drain of the present type are typically installed in poured concrete floors, the floor drain are precisely located and aligned with the finished grade so as to ensure proper operation of the floor drain and to not pose a tripping hazard. Floor drains of this variety are found in numerous types of installation sites including, without limitation, the kitchens, restrooms, showers, locker rooms, patios, etc. of various types of institutions, including, again without limitation, schools, restaurants, hotels, hospitals, correctional facilities and mental health institutions.

Correctional facilities and mental health institutions have additional concerns in that there may residents at these facilities and institutions with suicidal tendencies. Recent statistics show that, annually, there are approximately 1800 in-patient suicides at mental health institutions, and that 75% of these suicides occur in the patient's bathroom, bedroom or closet. One method that patients contemplating suicide commonly consider or use involves the fastening a ligature to an object in the room. These objects might take many different forms, including a floor drain.

Typically, floor drains typically have a grate with a series of openings, generally holes or slots, to allow for the inflow of water. These openings can be used to attach a ligature (such as a string, cord, rope or wire) by looping the ligature through one opening, under the bridge or web between an adjacent opening, and back up and out of the adjacent opening. Once tied an anchor or ligature point is created.

While it may be impossible to completely eliminate the possibility of a patient suicide using a ligature, mental health and other institutions are desirous of incorporating structures within their facilities that discourage the formation of a ligature point. Such structures are typically referred to as ligature resistant structures.

SUMMARY

In satisfying the above, as well as overcoming various drawbacks and limitations in the art, in one aspect of the present invention, a strainer for a ligature resistant floor drain is provided. In a related aspect, a ligature resistant floor drain is provided and incorporates a strainer.

Accordingly, in one aspect, the invention provides a strainer for a ligature resistant floor drain in which a top plate includes portions defining a plurality of openings extending through the top plate. The openings including a first set of openings defining a first ring of openings and a second set of openings defining a second ring of openings, wherein the second ring of openings is located about the first ring of openings. The rings may be concentric. Extending from the top plate, a location between the first and second rings of openings, is a cylindrical extension that defines a longitudinal axis. A first web extends from the top plate between adjacent pairs of openings in the first ring of openings, and a second web extends from the top plate between adjacent pairs of openings in the second ring of openings.

In another aspect the invention provides a strainer for a ligature resistant floor drain in which the strainer includes a top plate having portions defining a plurality of openings that include a first set of openings defining an inner ring of openings and a second set of openings defining an outer ring of openings located about of the inner ring of openings. A cylindrical extension, which defines a central axis, extends from the top plate at a location between the inner and outer rings and separates the inner ring of openings from the outer ring of openings. A plurality of inner webs extends radially inward relative to the cylindrical extension and each of inner webs is located between an adjacent pair of openings of the inner ring thereby separating that adjacent pair of openings from one another. Additionally, a plurality of outer webs extends radially outward relative to the cylindrical extension. Each of the outer webs is located between an adjacent pair of openings of the outer ring of openings, thereby separating the adjacent pair of openings from one another in a manner similar to the inner webs and openings of the inner ring.

In another aspect, the cylindrical extension and adjacent ones of the inner webs cooperatively define an enclosing wall about one of the openings of the inner ring.

In a further aspect, each of the inner webs extends inwardly to a distal end thereof, the distal end of each of the inner webs being connected to the distal end of the inner web located adjacent thereto.

In an additional aspect, the distal ends of the inner webs are connected by a wall portion extending axially from the top plate.

In yet another aspect, the wall portion is defined by a second cylindrical extension extending from the top plate.

In a further aspect, each of the outer webs extends outwardly to a distal end thereof, the distal ends of each of the outer webs being connected to the distal end of the outer web located adjacent thereto.

In an additional aspect, the cylindrical extension and adjacent ones of the outer webs cooperatively define an enclosing wall about one of the openings of the outer ring.

In still another aspect, the distal ends of the outer webs are connected by a wall portion extending axially from the top plate.

In yet a further aspect, the wall portion is defined by a third cylindrical wall extending from the top plate.

In an additional aspect, a strainer plate is coupled to the cylindrical extension and extending parallel to the top plate.

In another aspect, the strainer plate is an annular ring, the annular ring extending at least one of inwardly and outwardly from the cylindrical extension.

In a further aspect, the first set of openings are radially offset from the second set of openings and the inner webs are radially offset from the outer webs.

In yet an additional aspect, the top plate, the cylindrical extension, the inner webs and the outer webs are of a unitarily construction.

In an additional aspect, the strainer is mounted to a strainer frame. The strainer frame includes portions defining a receptacle and the strainer is received in the receptacle.

The strainer frame further including an outlet that is in fluid communication with both of the first and second sets of openings.

In another aspect, the invention provides a ligature resistant floor drain including a strainer and a strainer frame. The strainer includes a top plate having portions defining a plurality of openings extending through the top plate, the plurality of openings including a first set of openings defining an inner ring of openings and a second set of openings defining an outer ring of openings. The outer ring of openings is located radially outward of the inner set of openings. A first cylindrical extension extends from the top plate at a location between the inner ring of openings and the outer ring of openings and separates the inner ring of openings from the outer ring of openings. The first cylindrical extension also defines the central axis of the floor drain. A second cylindrical extension extends from the top plate at a location radially inward of the inner ring of openings, and a third cylindrical extension extends from the top plate at a location radially outward of the outer ring of openings. A plurality of inner webs extends between the first cylindrical extension and the second cylindrical extension. Each of the inner webs is located between an adjacent pair of openings of the inner ring of openings and separates the adjacent pair of openings from one another. A plurality of outer webs extends between the first the cylindrical extension and the third cylindrical extension. Each of the outer webs is located between an adjacent pair of openings of the outer ring of openings and separates the adjacent pair of openings from one another. The strainer is mounted to a strainer frame in a receptacle defined in the strainer frame. The strainer frame further including portions defining an outlet, and the outlet is in fluid communication with both of the first and second sets of openings.

In a further aspect, the first cylindrical extension has an axial length greater than an axial length of at least one of the second and third cylindrical extensions.

In an additional aspect, a strainer plate is mounted to the first cylindrical extension and extends substantially parallel to the top plate, the strainer plate extends at least one of radially inward and radially outward from the first cylindrical extension.

In still another aspect, the strainer plate is in the form of an annular ring having portions defining an inner aperture and portions defining an outer perimeter.

In yet a further aspect, the inner aperture defines a diameter that is less than an inner diameter defined by the first cylindrical extension.

In an additional aspect, the inner aperture defines a diameter that is less than an outer diameter defined by the second cylindrical extension.

In yet another aspect, the inner aperture defines a diameter that is greater than an outer diameter defined by the first cylindrical extension.

In still a further aspect, the outer perimeter defines a diameter that is less than an inner diameter defined by the third cylindrical extension.

Further objects, features and advantages of this invention will become readily apparent to persons skilled in the art after review of the following description, including the claim, with reference to the drawings that are appended to and form a part of this specification.

DETAILED DESCRIPTION

As used in the description that follows, directional terms such as "upper" and "lower" are used with reference to the orientation of the features and elements of the floor drain, as represented by the installed position and as generally shown in the figures. Accordingly, "upper" indicates a direction toward the top of the figure or toward the exposed portion of the installed floor drain and "lower" indicates a direction toward the bottom of the figure or toward the non-exposed portions of the of the figure. The terms "inward" or "inner" and "outward" or "outer" indicate a direction that is generally toward or away from a central axis of the floor drain, whether or not such an axis is designated in the referred to figure. An axial surface is one that faces in the axial direction. In other words, an axial surface faces in a direction generally along the central axis. A radial surface therefore faces radially, generally away from or toward the central axis.

Figure 1:
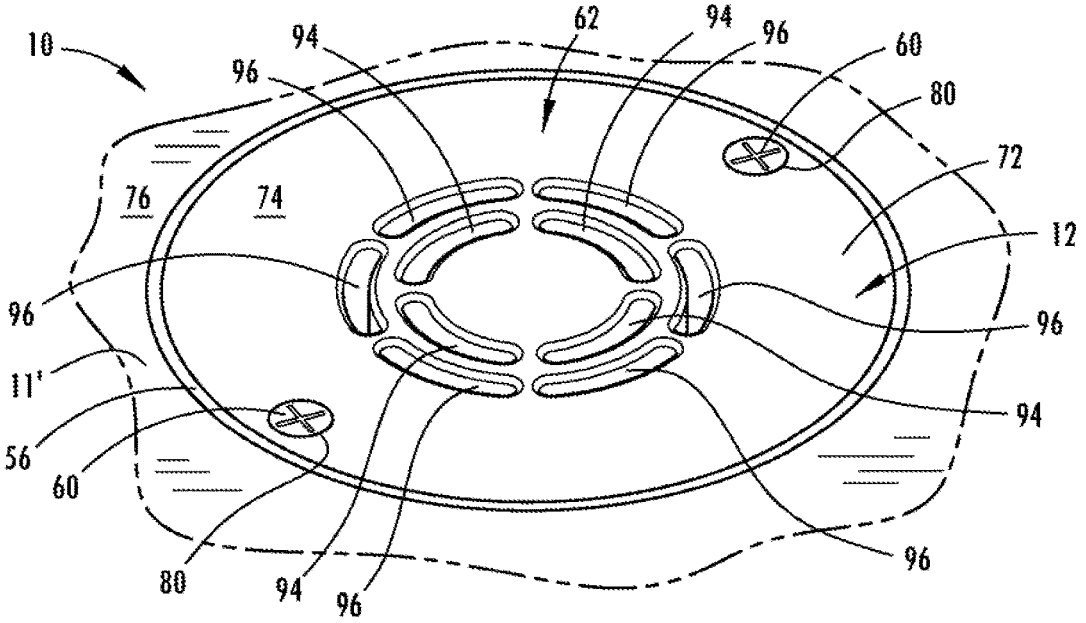
FIG. 1 is a perspective view of a floor drain embodying the principles of the present invention, installed in a floor.
Figure 2:
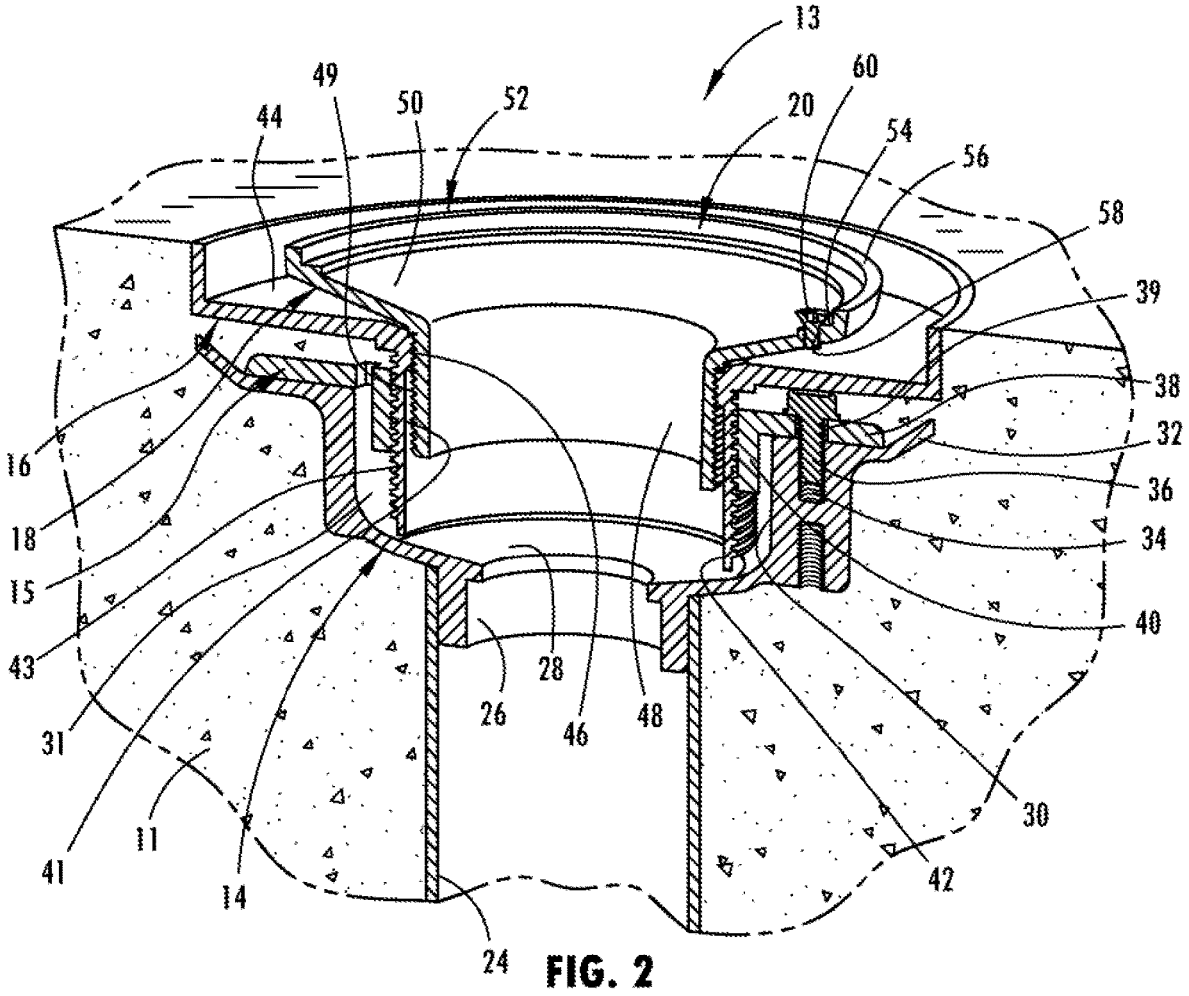
FIG. 2 is a cross-sectional view of the floor drain seen in FIG. 1 with the grate removed therefrom.
Figure 3:
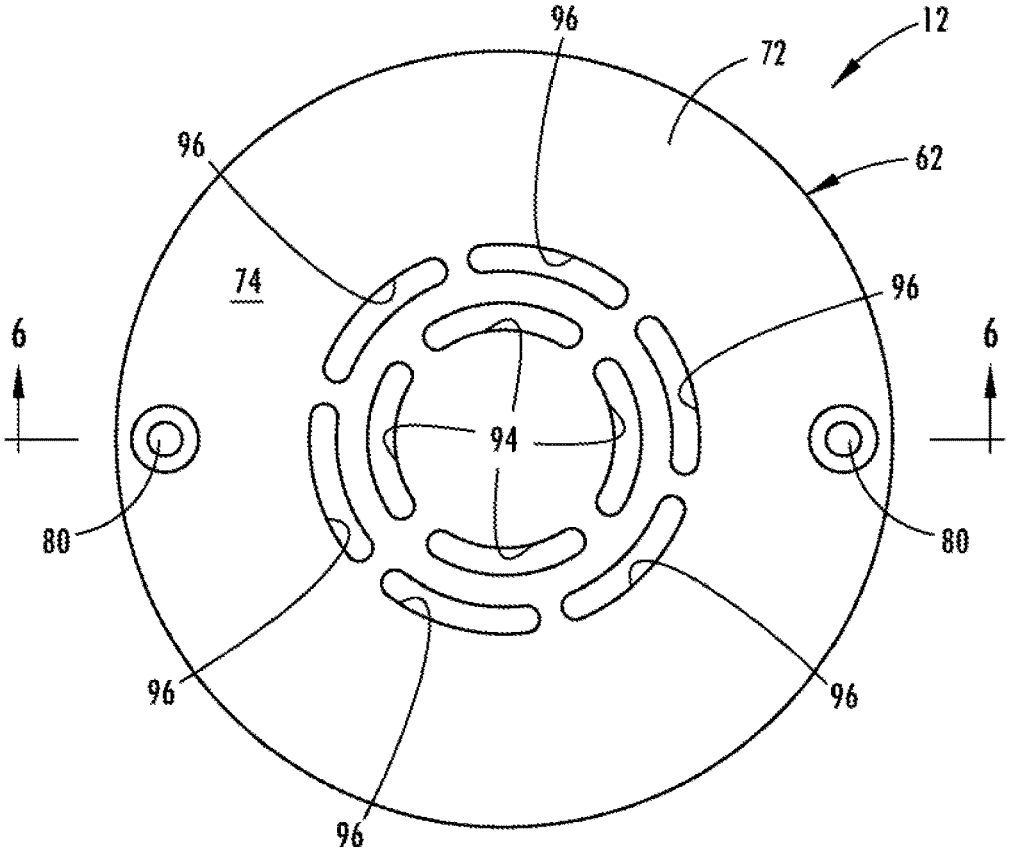
FIG. 3 is a top plan view of the grate seen in FIG. 1.

Referring now to the drawings, a floor drain 10 is generally illustrated in FIGS. 1 and 2 installed in a concrete floor 11. The floor drain 10 includes as its principal components a grate 12 and a drain assembly 13. As further explained below, the grate 12 mounts to the drain assembly 13 so as to be visible from above the concrete floor 11. While illustrated in connection with a concrete floor 11, it will be appreciated that the floor drain 10 may be installed in floors having other constructions.

The drain assembly 13 is configured to engage with a drain pipe 24 of the drain system at building or installation site. The drain assembly 13 may include a drain body 14, a collar 15 and a strainer frame 18 to which the grate 12 is mounted. Additionally, the drain assembly 12 may include a rough-in adapter 16 mounted between the collar 15 and the strainer frame 18. In its simplest form, the drain assembly 10 includes just the strainer frame 18, which in such an instance would itself engage the drain pipe 24 of the drain system.

Referring to FIG. 2, the drain body 14 includes a centrally located outlet coupling 26, extending axially and downwardly from a bottom wall 28, that is received within an open end of the drain pipe 24 of the drain system. While shown received within the drain pipe 24, the outlet coupling 26 may be located about the drain pipe 24 with an appropriate seal being located between the two portions. The drain body 14 may also include a cylindrical sidewall 30, larger in diameter than the outlet coupling 26, extending axially upward from the bottom wall 28 so as to define a receptacle cavity 31 in the drain body 14. At the upper end of the sidewall 30, the drain body 14 is provided with a radially outward extending flange 32. The flange 32 and sidewall 30 may include threaded bores 34 for receiving correspondingly threaded fasteners 36 to mount the collar 15 to the drain body 14.

The collar 15 also includes a radial flange 38, which is sized to be received on the flange 32 of the drain body 14. The collar's flange 38 is provided with bores or slots 39, corresponding with the threaded bores 34 in drain body's flange 32 and through which the previously mentioned threaded fasteners 36 may be inserted for engagement with the threaded bores 34. At the radially inward extent of the collar's flange 38, the collar 15 includes an internally threaded and axially extending shank 40. The outer diameter of the shank 40 is less than the inner diameter defined by the cylindrical sidewall 30 of the drain body 14. Providing the shank 40 with such a reduced diameter allows the collar 15 to be mounted on the drain body 14 with the shank 40 extending either upward or downward. Mounting the collar 15 with the shank 40 in the upward position provides the floor drain 10 with its tallest possible assembled height. Mounting the collar 15 with the shank 40 in the downward position, the shank 40 extends into the receptacle cavity 31 and provides the floor drain 10 with a shorter assembled height.

In one embodiment, the strainer frame 18 engages the shank 40 of the collar 15 through its own shank 48, which is provided with external threads 49 corresponding to internal threads 41 provided on the collar's shank 40. The shank 48 defines the outlet portion of the strainer frame 18. To receive and direct water to the shank 48 and through the floor drain 10, a receptacle or funnel portion 50 extends outwardly and at least slightly upwardly from the upper extent of the shank 48. Provided at the outer perimeter of the funnel portion 50 is a rim 52 defining the desired shape for the drain assembly 13. The shape may be, without limitation, a round configuration or square configuration. The rim 52 may include both a flat 54 and an adjacent lip 56, with the lip 56 extending axially. These features, the flat 54 and lip 56, may cooperate to receive the grate 12, which is further discussed below, within the funnel portion of the strainer frame 18. More specifically, the grate 12 is received on the flat 54 inside of the lip 56 and is fixedly mounted to the strainer frame 18 via threaded bores 58 in the flat 54 that receive threaded fasteners 60 extending through the grate 12. Alternately, other retaining mechanisms may be employed.

If provided with a rough-in adapter 16, as seen in FIG. 2, the adapter 16 includes an axially extending shank 42 and a radially extending flange 44. The shank 42 of the adapter 16 is externally threaded 43 and of a diameter allowing the shank 42 to be threadably received within the shank 40 of the collar 15. With this construction, the upper end of the shank 42 of the adapter 16 is further provided with an internally threaded portion 46 to receive and engage the external threads 49 of the shank 48 of the strainer frame 18.

Figure 4:
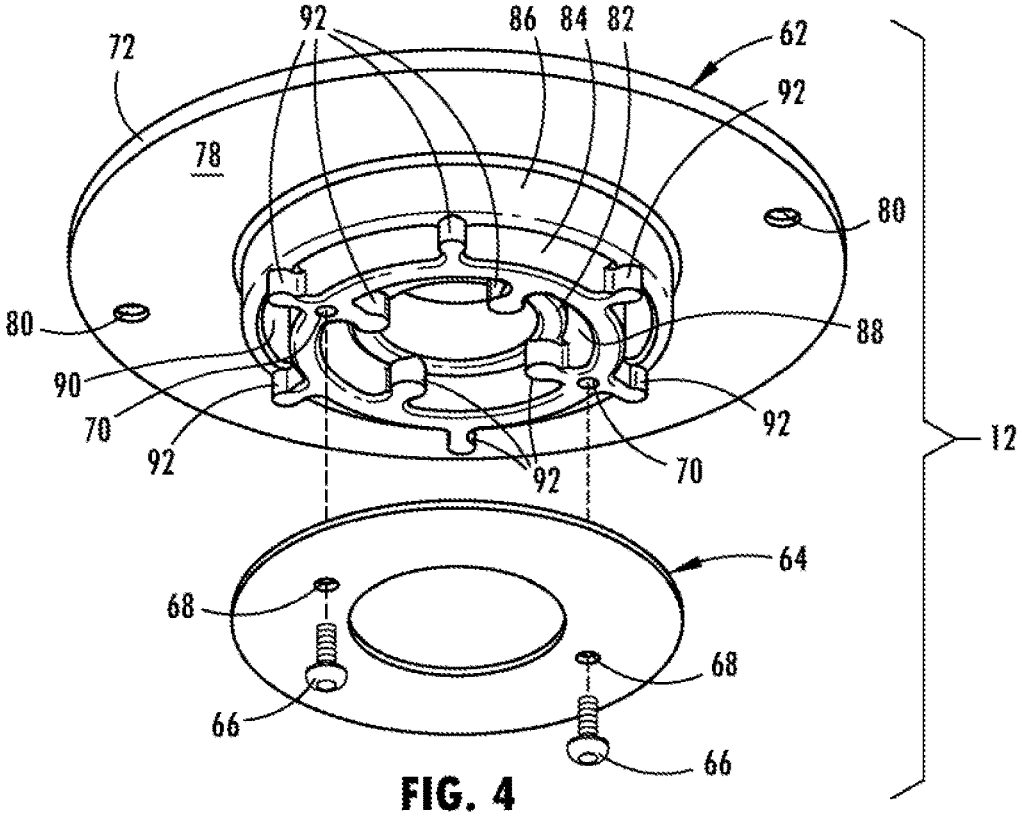
FIG. 4 is an exploded perspective view, generally viewed from the bottom, of the grate and showing the strainer and strainer plate thereof.
Figure 5:
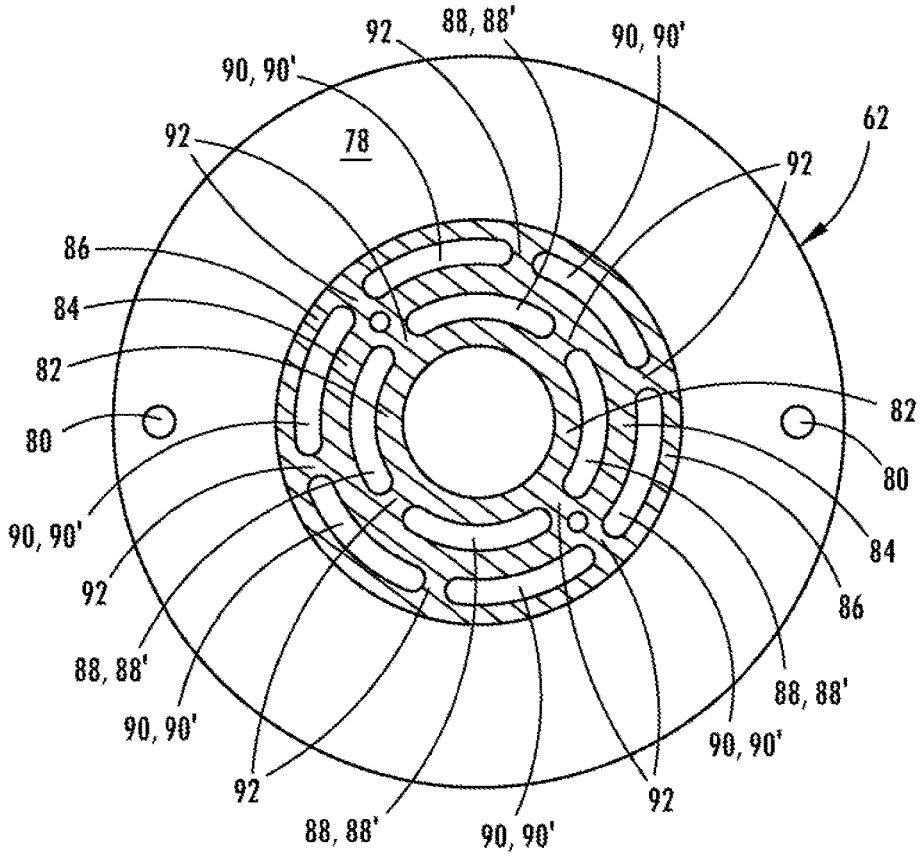
FIG. 5 is a bottom plan view of the grate seen in FIG. 4, with a portion of the grate shown in section.
Figure 6:
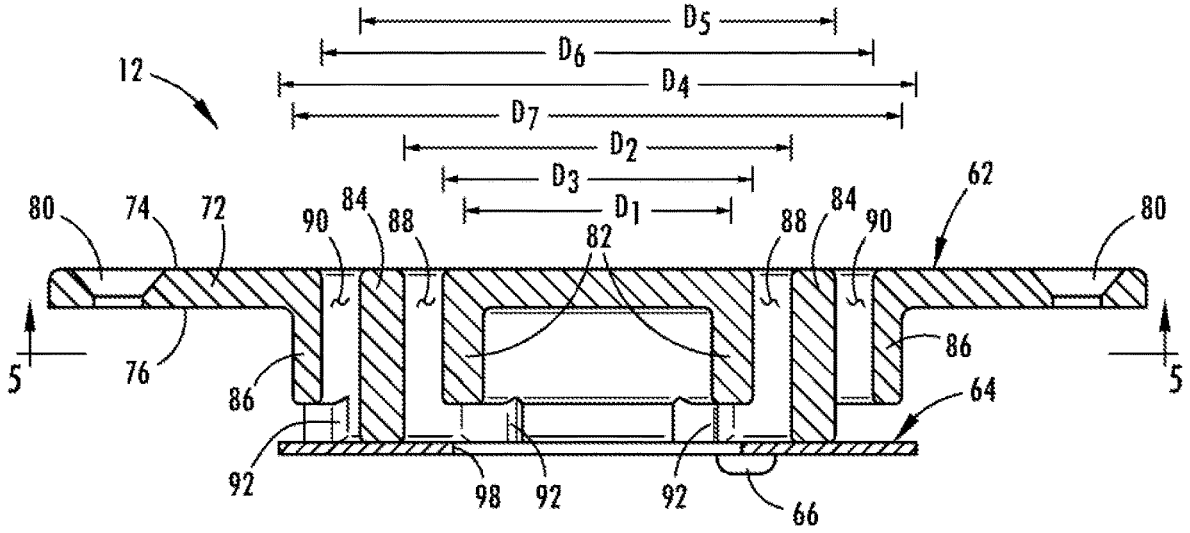
FIG. 6 is cross-sectional view of an assembled grate, generally taken along line 6-6 in FIG. 3.
Figure 7:
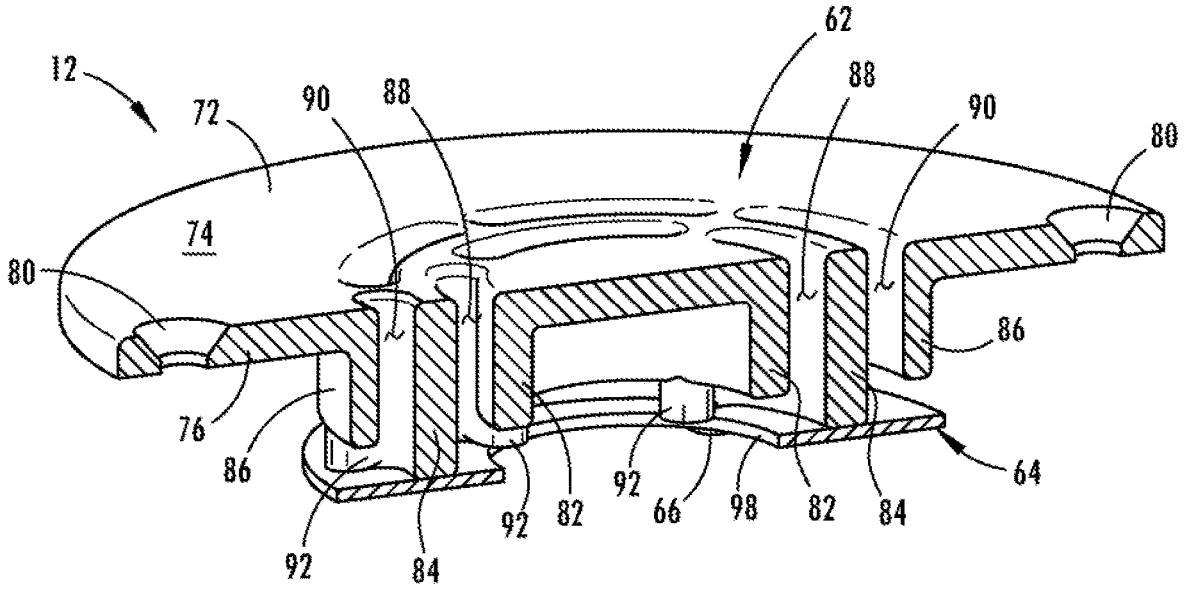
FIG. 7 is a perspective view of the grate seen in FIG. 6.
Figure 8:
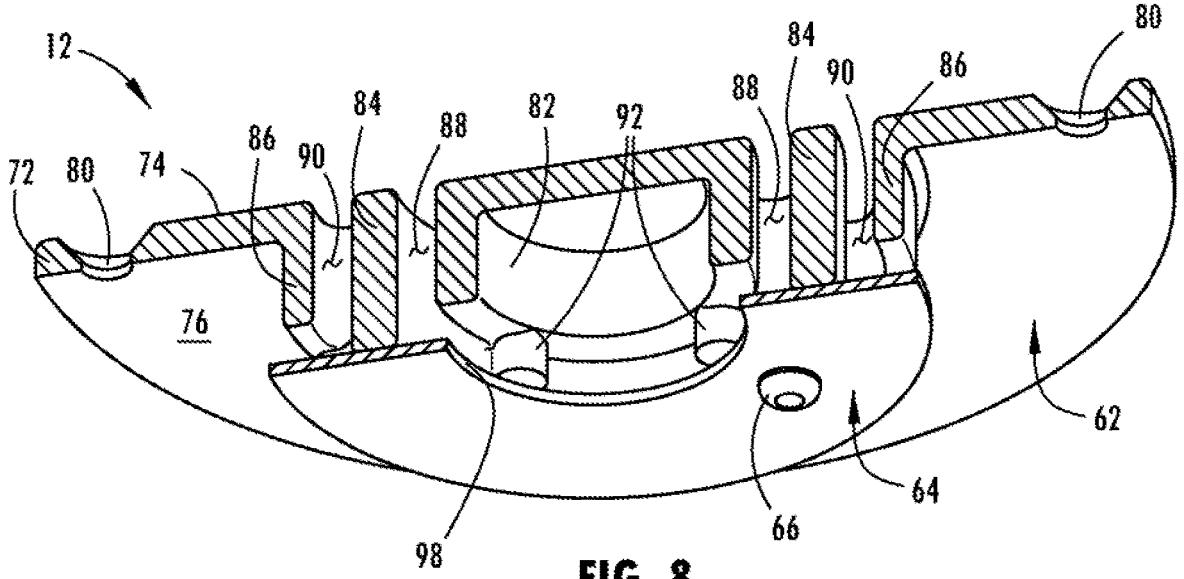
FIG. 8 is another perspective view of the grate seen in FIG. 6, generally seen from the bottom.

As readily seen in FIG. 4, the grate 12 includes two components, a strainer 62 and a strainer plate 64. Preferably, the strainer plate 64 is secured to the bottom of the strainer 62 using threaded fasteners 66 inserted through bores 68 in the strainer plate 64 and into threaded bores 70 defined in a portion of the strainer 62, as further discussed below.

The strainer 62 is preferably a one-piece, unitary structure formed as a casting in lieu of a fabricated assembly. However, as an alternative, the strainer 62 may be fabricated and formed by multiple pieces joined together to form the strainer 62.

Referring now to FIGS. 4-8, the strainer 62 includes a top plate 72 having an upper surface 74 that, when installed in a finished floor 11', is substantially flush with the upper surface 76 of the finished floor 11'. As mentioned above, the strainer 62 includes bores 80, provided through the top plate 72, allowing for the insertion of fasteners 60 and securing of the grate 12 to the drain assembly 13.

Projecting from the bottom surface 78 of the top plate 72 are three concentric and generally cylindrical walls, which are herein referred to as an inner cylindrical wall 82, an intermediate cylindrical wall 84, and an outer cylindrical wall 86. While three wall are shown, the number of walls may be more or less than three. The cylindrical walls 82, 84, 86 are each spaced apart from one another and define an inner cylindrical space 88, located between the inner cylindrical wall 82 and intermediate cylindrical wall 84, and an outer cylindrical space 90, located between the intermediate cylindrical wall 84 and the outer cylindrical wall 86.

Webs 92 extend radially, at spaced intervals, between adjacent ones of the cylindrical walls 82, 84, 86. The webs 92 divide each of the inner and outer cylindrical spaces 88, 90 into multiple chamber 88', 90'. As seen in FIGS. 3 and 5-7, the intermediate cylindrical wall 84 extends an axial distance from the top plate 72 that is greater than an axial distance that the inner and outer cylindrical walls 82, 86 extend from the top plate 72. As also seen in those figures, the axial distance that the webs 92 extend from the bottom surface 78 of the top plate 72 is the same as the distance the intermediate cylindrical wall 84 extends from the bottom surface 78 of the top plate 72.

Also provide in the top plate 72 are a series of openings 94, 96. The openings 94, 96 cooperate for form two segmented concentric rings, with the openings 94 forming an inner ring and the openings 96 forming an outer ring about the inner ring. Each opening 94, 96 of each concentric ring respectively corresponds with one chamber 88', 90' formed by the cylindrical walls 82, 84, 86 and webs 92. Cooperatively, the openings 94, 96 and chambers 88', 90' define individual passageways through the strainer 62 and grate 12. In some embodiments, the openings 94, 96 may taper as they extend through the top plate 72 from the upper surface of the top plate into the floor drain 10.

As previously noted, the mounted to the bottom of the strainer 62 is the strainer plate 64. More specifically, the strainer plate 64 is mounted to the bottom of the intermediate cylindrical wall 84, which may be achieved through use of the threaded fasteners 66 inserted through bores 68 in the strainer plate 64 and into threaded bores 70 defined in the intermediate cylindrical wall 84.

As best seen in FIGS. 4-8, the strainer plate 64 is a ring shaped plate structure and therefore includes a central opening 98. The central opening 98 has a diameter $D_1$ that is preferably less than the inner diameter $D_2$ defined by the intermediate cylindrical wall 84. As seen from FIG. 6, the diameter $D_1$ of the central opening 98 is shown to be less than the outer diameter $D_3$ defined by the inner cylindrical wall 82. The outer diameter $D_4$ of the strainer plate 64 is preferably greater than the outer diameter $D_5$ defined by the intermediate cylindrical wall 84, more preferably greater than inner diameter $D_6$ defined by the outer cylindrical wall 86, and most preferably greater than outer diameter $D_7$ defined by the outer cylindrical wall 86.

Provided as noted above, the strainer plate 64 cooperates with the cylindrical walls 82, 84, 86 to form the individual passageways via the inner chambers 88' radially inward and the individual passageways of outer chambers 90' radially outward. Notably, at least a portion of radially outboard side of the outer chambers 90' is not obstructed by the outer cylindrical wall 86. With the present construction, it is render difficult to pass a ligature either from one of the inner chambers 88' to one of the outer chambers 90' (or vice versa) or between adjacent ones of inner chambers 88' or adjacent ones of outer chambers 90', thereby rendering it difficult to form a ligature point. The construction does not, however, obstruct the flow of water through the floor drain 10.

The above description is meant to be illustrative of at least one preferred implementation incorporating the principles of the invention. One skilled in the art will really appreciate that the invention is susceptible to modification, variation and change without departing from the true spirit and fair scope of the invention, as defined in the claims that follow. The terminology used herein is therefore intended to be understood in the nature of words of description and not of limitation.

I claim:

1. A strainer for a ligature resistant floor drain, the strainer comprising:

a top plate having portions defining a plurality of openings extending through the top plate, the plurality of openings including a first set of openings defining a first ring of openings and a second set of openings defining a second ring of openings located about the first ring of openings;

a cylindrical extension extending from the top plate and having inner and outer cylindrical wall surfaces provided at a location between the first and second rings of openings, the cylindrical extension separating the first ring of openings from the second ring of openings and defining a longitudinal axis;

a first web extending from the top plate between adjacent pairs of openings in the first ring of openings; and a second web extending from the top plate between adjacent pairs of openings in the second ring of openings, the second web extending radially beyond the second ring of openings.

2. A grate incorporating the strainer according to claim 1, the grate further comprising a strainer plate mounted to the cylindrical extension and extending radially inward of the cylindrical extension parallel to the top plate.

3. The grate according to claim 2, wherein the strainer plate is an annular ring, the annular ring extending at least one of inwardly and outwardly from the cylindrical extension.

4. The strainer according to claim 1, wherein the openings are tapered openings through the top plate.

5. A ligature resistant floor drain incorporating the strainer of claim 1, further comprising a strainer frame, the strainer frame including portions defining a receptacle, the strainer being received in the receptacle, the strainer frame further including an outlet in fluid communication with both of the first and second sets of openings.

6. The strainer according to claim 1, wherein at least one of the inner and outer cylindrical wall surfaces coinciding with portions defining at least one of the first and second sets of openings.

7. A strainer for a ligature resistant floor drain, the strainer comprising:

a top plate having portions defining a plurality of openings extending through the top plate, the plurality of openings including a first set of openings defining an inner ring of openings and a second set of openings defining an outer ring of openings, the outer ring of openings being located about of the inner ring of openings;

a cylindrical extension extending from the top plate and having coaxial inner and outer cylindrical wall surfaces provided at a location between the inner ring of openings and the outer ring of openings and separating the inner ring of opening from the outer ring of openings, the cylindrical wall defining a central axis;

a plurality of inner webs extending radially inward relative to the cylindrical extension, each of the inner webs being located between an adjacent pair of openings of the inner ring of openings and separating said adjacent pair of openings from one another; and a plurality of outer webs extending radially outward relative to the cylindrical extension, each of the outer webs being located between an adjacent pair of openings of the outer ring of openings and separating said adjacent pair of openings from one another, the outer webs extending radially beyond the second set of openings.

8. The strainer according to claim 7, wherein the cylindrical extension and adjacent ones of the inner webs cooperatively define an enclosing wall about one of the openings of the inner ring.

9. The strainer according to claim 7, wherein each of the inner webs extends inwardly to a distal end thereof, the distal end of each of the inner webs being connected to the distal end of the inner web located adjacent thereto.

10. The strainer according to claim 9, wherein the distal ends of the inner webs are connected by a wall portion extending axially from the top plate.

11. The strainer according to claim 10, wherein the wall portion is defined by a second cylindrical extension extending from the top plate.

12. The strainer according to claim 7, wherein each of the outer webs extends outwardly to a distal end thereof, the distal ends of each of the outer webs being connected to the distal end of the outer web located adjacent thereto.

13. The strainer according to claim 12, wherein the cylindrical extension and adjacent ones of the outer webs cooperatively define an enclosing wall about one of the openings of the outer ring.

14. The strainer according to claim 12, wherein the distal ends of the outer webs are connected by a wall portion extending axially from the top plate.

15. The strainer according to claim 14, wherein the wall portion is defined by a third cylindrical wall extending from the top plate.

16. The strainer according to claim 7, wherein the first set of openings are radially offset from the second set of openings and the inner webs are radially offset from the outer webs.

17. The strainer according to claim 7, wherein the top plate, the cylindrical extension, the inner webs and the outer webs are of a unitarily construction.

18. The strainer according to claim 7, wherein at least one of the inner and outer cylindrical wall surfaces coinciding with portions defining at least one of the first and second sets of openings.

19. A ligature resistant floor drain, the floor drain comprising:

a grate and a strainer frame;

the grate including a top plate having portions defining a plurality of openings extending through the top plate, the plurality of openings including a first set of openings defining an inner ring of openings and a second set of openings defining an outer ring of openings, the outer ring of openings being located radially outward of the inner set of openings;

a first cylindrical extension extending from the top plate and having inner and outer cylindrical wall surfaces provided at a location between the inner ring of openings and the outer ring of openings and separating the inner ring of opening from the outer ring of openings, the first cylindrical extension defining a central axis;

a second cylindrical extension extending from the top plate and having second inner and outer cylindrical wall surfaces provided at a location radially inward of the first cylindrical extension and the inner ring of openings;

a third cylindrical extension extending from the top plate and having third inner and outer cylindrical wall surfaces provided at a location radially outward of the first cylindrical extension and the outer ring of openings;

a plurality of inner webs extending between the first cylindrical extension and the second cylindrical extension, each of the inner webs being located between an adjacent pair of openings of the inner ring of openings and separating said adjacent pair of openings from one another;

a plurality of outer webs extending between the first the cylindrical extension and the third cylindrical extension, each of the outer webs being located between an adjacent pair of openings of the outer ring of openings and separating said adjacent pair of openings from one another; and the strainer frame including portions defining a receptacle, the strainer being received in the receptacle, the strainer frame further including portions defining an outlet, the outlet being in fluid communication with both of the first and second sets of openings.

20. The floor drain according to claim 19, further comprising a strainer plate coupled to the first cylindrical extension and extending from the first cylindrical extension substantially parallel to the top plate, the strainer plate extending at least one of radially inward and radially outward from the first cylindrical extension.

21. The floor drain according to claim 20, wherein the strainer plate is in the form of an annular ring having portions defining an inner aperture and portions defining an outer perimeter.

22. The floor drain according to claim 21, wherein the inner aperture defines a diameter that is less than an inner diameter defined by the first cylindrical extension.

23. The floor drain according to claim 21, wherein the inner aperture defines a diameter that is less than an outer diameter defined by the second cylindrical extension.

24. The floor drain according to claim 21, wherein the outer perimeter defines a diameter that is greater than an outer diameter defined by the first cylindrical extension.

25. The floor drain according to claim 23, wherein the outer perimeter defines a diameter that is less than an inner diameter defined by the third cylindrical wall.

26. The floor drain according to claim 19, wherein the opening are tapered openings through the top plate.

27. A ligature resistant floor drain, the floor drain comprising:

a grate and a strainer frame;

the grate including a top plate having portions defining a plurality of openings extending through the top plate, the plurality of openings including a first set of openings defining an inner ring of openings and a second set of openings defining an outer ring of openings, the outer ring of openings being located radially outward of the inner set of openings;

a first cylindrical extension extending from the top plate at a location between the inner ring of openings and the outer ring of openings and separating the inner ring of opening from the outer ring of openings, the first cylindrical extension defining a central axis;

a second cylindrical extension extending from the top plate at a location radially inward of the inner ring of openings;

a third cylindrical extension extending from the top plate at a location radially outward of the outer ring of openings;

the first cylindrical extension having an axial length greater than an axial length of at least one of the second and third cylindrical extensions;

a plurality of inner webs extending between the first cylindrical extension and the second cylindrical extension, each of the inner webs being located between an adjacent pair of openings of the inner ring of openings and separating said adjacent pair of openings from one another;

a plurality of outer webs extending between the first the cylindrical extension and the third cylindrical extension, each of the outer webs being located between an adjacent pair of openings of the outer ring of openings and separating said adjacent pair of openings from one another; and the strainer frame including portions defining a receptacle, the strainer being received in the receptacle, the strainer frame further including portions defining an outlet, the outlet being in fluid communication with both of the first and second sets of openings.

* * * * *